US005458378A

United States Patent [19]

Crawford

[11] Patent Number: 5,458,378

[45] Date of Patent: Oct. 17, 1995

[54] RECORD KEEPING SYSTEM

[76] Inventor: David Crawford, 524 Throckmorton Ave., Mill Valley, Calif. 94941

[21] Appl. No.: 51,182

[22] Filed: Apr. 22, 1993

[51] Int. Cl.[6] ..... B42D 15/00

[52] U.S. Cl. ..... 283/67; 283/115

[58] Field of Search ..... 283/115, 45, 61, 283/66.1, 66.2, 117, 81, 101; 462/6, 66, 900; 281/2, 5, 38

[56] References Cited

U.S. PATENT DOCUMENTS

| | | | |
|---|---|---|---|
| 4,277,089 | 7/1981 | Lockharet | 283/115 X |
| 4,409,057 | 10/1983 | Molenda . | |
| 4,471,977 | 9/1984 | Stackhouse . | |
| 4,526,403 | 7/1985 | Park . | |
| 4,529,227 | 7/1985 | Fields . | |
| 4,558,888 | 12/1985 | Hanson . | |
| 4,568,108 | 2/1986 | Simpson . | |
| 4,592,572 | 6/1986 | Instance . | |
| 4,643,455 | 2/1987 | North et al. | 283/115 X |
| 4,714,276 | 12/1987 | Greig . | |
| 4,768,810 | 9/1988 | Mertens . | |
| 4,895,746 | 1/1990 | Mertens . | |
| 4,905,392 | 4/1988 | Klein . | |
| 4,913,462 | 4/1990 | Parker . | |
| 4,930,812 | 8/1988 | Howard . | |
| 4,934,740 | 6/1990 | Drake . | |
| 4,955,640 | 9/1990 | Anderson . | |
| 5,002,310 | 3/1991 | Gilpin . | |
| 5,026,196 | 6/1991 | Brass . | |
| 5,029,903 | 7/1991 | Pennock . | |
| 5,040,216 | 8/1991 | Policht . | |
| 5,050,909 | 9/1991 | Mertens et al. . | |
| 5,052,872 | 10/1991 | Hunder . | |
| 5,060,980 | 10/1991 | Johnson et al. | 283/115 X |
| 5,011,186 | 4/1991 | Bodziak, et al. . | |
| 5,074,595 | 12/1991 | Hill . | |
| 5,129,682 | 7/1992 | Ashby . | |
| 5,153,041 | 10/1992 | Clements et al. . | |
| 5,174,605 | 12/1992 | Instance . | |

*Primary Examiner*—Willmon Fridie
*Attorney, Agent, or Firm*—Coudert Brothers

[57] ABSTRACT

A record keeping system is described whereby computer printed data and hand entered data may be juxtaposed in a mutually conforming format. A chart has an orthogonal matrix printed thereon in which one axis represents a succession of time periods and one axis represents an array of different parameters. A subset of the field spaces is set aside for hand entered data and another subset is set aside for overlay sheets of computer printed data substantially aligned with and conforming to the field spaces of that subset. An adhesive coating covers a portion of the chart to enable attachment of the overlay sheets in the aligned position.

9 Claims, 1 Drawing Sheet

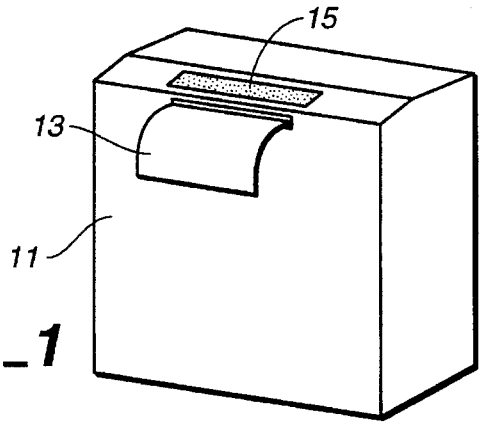
FIG._1
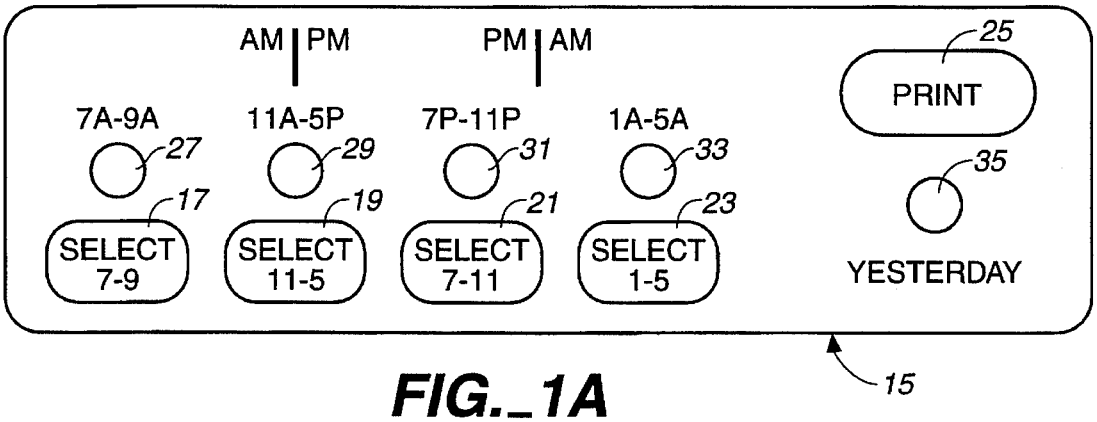
FIG._1A
FIG._2
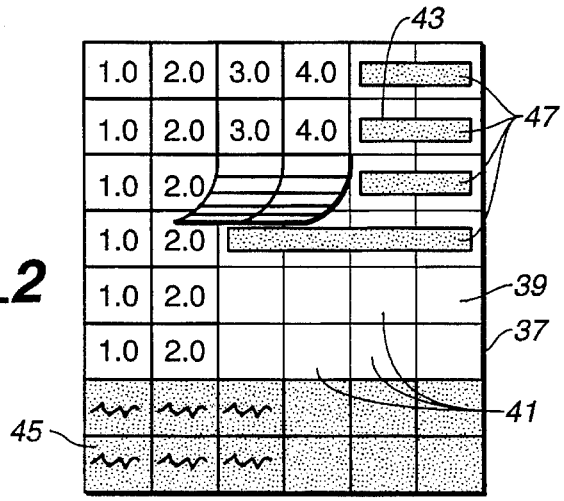

RECORD KEEPING SYSTEM

This invention relates generally to record keeping. More particularly, the invention relates to a record keeping system including a chart for juxtaposing computer primed data and hand entered data in a mutually conforming format.

BACKGROUND OF THE INVENTION

Data are often entered in an orthogonal matrix of field spaces printed on a chart. For example, patient data in a hospital setting may be entered for a succession of time periods, such data comprising various monitored parameters of patient condition, such as temperature, pulse rate, etc.

In many situations, data may be gathered by a computer and printed out on computer generated sheets. Data collected by computers are not vulnerable to transcription error. Computer data collection is in a consistent and timely fashion, and this data can be printed accurately and legibly. However, manual entry of data is often still used where the data can not be easily acquired or printed by a computer. In some instances, the computer data may not be easily printed in the format of the form in use. Accordingly, there are many circumstances wherein it may be desirable to juxtapose data collected via computer in combination with data which are obtained and recorded manually.

One approach to juxtaposing computer generated data and hand recorded data is to simply print the entire data form or chart every time new data has been collected by computer and to reenter the other data on the form or chart by hand. Each time more data become available, the form is printed anew. In such an instance, the data collected and written in by hand on the first printing of the form would be lost when the second printing of the form was made. Therefore, the successive forms will contain hand entered data only with respect to the most recent period of time. In many instances, this is not satisfactory.

Accordingly, it is an object of the present invention to provide an improved record keeping system wherein computer printed data and hand entered data may be juxtaposed in a mutually conforming format.

Another object of the invention is to provide such a system wherein hand entered data is retained and not lost upon entry of new computer generated data for successive time periods.

Another object of the invention is to provide an improved record keeping chart for use in such a system.

A further object of the invention to provide an improved record keeping method employing a system in accordance with the invention.

Other objects of the invention will become apparent to those skilled in the art from the following description and accompanying drawings.

DESCRIPTION OF THE DRAWINGS

FIG. 1 is a schematic diagram illustrating the various components of a system employing the invention.

FIG. 2 is a perspective view of a chart constructed in accordance with the invention utilizing overlay sheets of computer printed data in accordance with the invention.

SUMMARY OF THE INVENTION

Very generally, the record keeping system of the invention juxtaposes computer printed data and hand entered data in a mutual conforming format. A chart having a substantially planar surface is provided with an orthogonal matrix of field spaces printed thereon. The matrix has one axis representing a succession of time periods and one axis representing an array of different parameters. The matrix has two subsets of field spaces, with the field spaces in each subset being contiguous. An adhesive coating covers a portion of the chart. The adhesive coating is located such that overlay sheets of computer printed data may be attached to the chart substantially aligned with and conforming to one of the subsets of field spaces.

DETAILED DESCRIPTION OF THE INVENTION

Referring now to FIG. 1, a record keeping system constructed in accordance with the invention is illustrated schematically. The system includes a computer/printer 11 for printing paper strips containing computer generated data. The strips are indicated at 13 emerging from the computer/printer 11. The computer/printer also contains a control panel 15 for controlling the printing of strips of computer generated data for a given time period. As may be seen from the control panel 15, buttons for selecting the different time periods desired are provided. Thus, for example if the time periods were two hours apart, a button 17 is provided for selecting the 7 to 9 A.M. time period, a button 19 is provided for selecting the 11 A.M. to 5 P.M. (11 A.M., 1 P.M., 3 P.M., 5 P.M.) time period, a button 21 is provided for selecting the 7 P.M. to 11 P.M. time period and, finally a button 23 is provided for selecting the 1 A.M. to 5 A.M. time period. A print button 25 is also provided. A series of lights 27, 29, 31, and 33 are provided for each time period indicating when the data are collected and ready to print. A light 35 marked "yesterday" is also provided for indicating the presence of yesterday's data in the computer.

Data for the respective time periods are printed out on a paper strip representing that particular time period. The data are arrayed along the strip at different location along the longitudinal axis thereof, each data entry representing a different monitored parameter. These strips are attached to an adhesive coating on a record keeping chart 37, described in more detail in connection with FIG. 2.

Referring now to FIG. 2, the chart 37 is shown with its upper substantially planar surface 39 having an orthogonal matrix of field spaces 41 printed thereon. The matrix, as shown in FIG. 2, has vertical axis and a horizontal axis. Successive time periods are distributed along the horizontal axis of the matrix, whereas the vertical axis represents an array of different monitored parameters.

The matrix has two subsets of field spaces 43 and 45. The field spaces 41 in each of the two subsets 43 and 45 are contiguous, as are the subsets with each other. The subset 45 is provided for entry of hand written data in the respective field spaces 41, whereas the subset 43 of field spaces acts as a phantom or dummy for the alignment of overlay sheets of computer generated data. The surface 39 of the chart, at least in the area of the subset 45, is of a material selected to permit manual recording of data in the field spaces.

In order to overlay sheets of computer generated data on the subset 43 of field spaces 41, the surface 39 of the record keeping chart 37 is provided with an adhesive coating covering a portion of the surface. In the illustrated embodiment, the coating comprises a plurality of adhesive strips 47 which are place horizontally across the top several rows of the field spaces 41 in the subset 43. The position of this coating is located such as to permit attachment of the overlay sheets of computer printed data substantially aligned with and conforming to the field spaces 41 in the subset 43. The data are printed out on the strips by the computer such that the outline of field spaces is printed thereon with the data entered in the appropriate field spaces for a given time period. These elongated strips are then placed on the chart adhering to the adhesive and lining up with the field spaces of the subset 43 already printed on the chart.

In the illustrated embodiment, the overlay sheets of computer printed data are elongated and are attached vertically over the upper portion of the chart. Each strip conforms to a predetermined time period and is aligned with the field spaces in the set 45 which correspond to that time period and in which hand written data are entered. The result is a record keeping system wherein computer printed data and hand entered data are juxtaposed in a mutually conforming format which is easy to read and easy to maintain. It is preferable that the adhesive 47 comprise pressure sensitive adhesive such as the type utilized on Post-it® note papers available from 3M Company. The record keeping chart is thereby capable of holding printed strips in exactly the same format as the original printed form on the chart, but with the data generated by the computer entered in the field spaces on the computer printed strips. The strips printed by the computer can contain data from one or more time periods and may be removed and replaced as necessary in the event the computer printed data are updated or revised. The adhesive strips 47 are reusable, thus enabling such replacement. The applicability of the system of the invention to the employment of strip printers enables the use of these relatively inexpensive and smaller devices.

It may be seen, therefore, that the invention provides an improved record keeping system and method, and an improved chart therefor, wherein computer printed data and hand entered data may be juxtaposed in a mutually conforming format. Various modifications of the invention, in addition to those shown and described herein, will become apparent to those skilled in the art from the foregoing description. Such modifications are intended to fall within the scope of the appended claims.

What is claimed is:

1. A record keeping chart for juxtaposing computer printed data and hand entered data in a mutually conforming format, comprising, a first substantially planar surface having one axis representing a succession of time periods and one axis representing an array of different parameters, said matrix having two subsets of said field spaces, said field spaces in each subset being contiguous, and an adhesive coating covering a portion of said surface of said chart, said adhesive coating being located to permit attachment of overlay sheets of computer printed data substantially aligned with and conforming to one of said subsets of field spaces, said portion of said surface covered by said adhesive coating being substantially coextensive with said one subset of field spaces.

2. A chart according to claim 1 wherein said adhesive coating covers a substantial portion of said one subset of field spaces.

3. A chart according to claim 1 wherein said axis representing a succession of time periods is horizontal with respect to said chart, and wherein said adhesive coating is arranged in a plurality of horizontal strips extending across selected parameters comprising said one subset of field spaces.

4. A record keeping system for juxtaposing computer printed data and hand entered data in a mutually conforming format, comprising, a chart having a first substantially planar surface having an orthogonal matrix of field spaces printed thereon, said matrix having one axis representing a succession of time periods and one axis representing an array of different parameters, said matrix having two subsets of said field spaces, said field spaces in each subset being contiguous, an adhesive coating covering a portion of said surface of said chart, and a plurality of overlay sheets of computer printed data secured to said adhesive coating and aligned with and conforming to one of said subsets of field spaces.

5. A system according to claim 4 wherein said adhesive coating covers a substantial portion of said one subset of field spaces.

6. A system according to claim 4 wherein said axis representing a succession of time periods is horizontal with respect to said chart, and wherein said adhesive coating is arranged in a plurality of horizontal strips extending across selected parameters comprising said one subset of field spaces.

7. A record keeping system according to claim 4 wherein said overlay sheets each comprise a strip having computer printed data thereon representing one of said time periods.

8. A record keeping method whereby strips containing computer printed data representing an array of different parameters for a predetermined time period may be juxtaposed with hand entered data in a mutually conforming format, said method comprising, providing a chart having a first substantially planar surface with an orthogonal matrix of field spaces printed thereon, said matrix having one axis representing a succession of time periods and one axis representing an array of different parameters, said matrix having two subsets of said field spaces, said field spaces in each subset being contiguous, said chart having an adhesive coating on a portion of said surface thereof, and attaching at least overlay sheet of computer printed data to said adhesive coating with said computer printed data substantially aligned with and conforming to one of the subsets of field spaces.

9. A record keeping method according to claim 8 wherein each overlay sheet comprises a strip of computer printed data for a predetermined time period, and wherein said strips are attached to said adhesive coating aligned with the field spaces for the same period in the other one of said subsets of field spaces.

* * * * *